US007472861B2

(12) United States Patent
Dooley et al.

(10) Patent No.: US 7,472,861 B2
(45) Date of Patent: Jan. 6, 2009

(54) METHOD FOR A SURFACE REWIND SYSTEM

(75) Inventors: Matthew Daniel Dooley, Morrow, OH (US); Brian Christopher Schwamberger, Fairfield Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 233 days.

(21) Appl. No.: 11/156,893

(22) Filed: Jun. 20, 2005

(65) Prior Publication Data

US 2006/0284000 A1 Dec. 21, 2006

(51) Int. Cl.
*B65H 18/14* (2006.01)

(52) U.S. Cl. ..... 242/541

(58) Field of Classification Search ..... 242/544, 242/534, 541.5, 541.6, 534.2, 542, 542.1; 700/126

See application file for complete search history.

(56) References Cited

U.S. PATENT DOCUMENTS

| | | | | |
|---|---|---|---|---|
| 3,871,598 | A * | 3/1975 | Kataoka | 242/413.2 |
| 4,327,877 | A | 5/1982 | Perini | |
| 4,487,377 | A | 12/1984 | Perini | |
| 4,723,724 | A | 2/1988 | Bradley | |
| 4,828,195 | A | 5/1989 | Hertel et al. | |
| 4,909,452 | A | 3/1990 | Hertel et al. | |
| 5,370,335 | A * | 12/1994 | Vigneau | 242/542.1 |
| 5,505,402 | A * | 4/1996 | Vigneau | 242/527.1 |
| 5,505,405 | A * | 4/1996 | Vigneau | 242/542.1 |
| 5,518,200 | A | 5/1996 | Kaji et al. | |
| 5,941,473 | A * | 8/1999 | Kawano et al. | 242/413.1 |
| 5,979,818 | A | 11/1999 | Perini et al. | |
| 6,402,076 | B1 * | 6/2002 | Werner | 242/413.1 |
| 6,648,266 | B1 | 11/2003 | Biagiotti et al. | |
| 7,000,864 | B2 * | 2/2006 | McNeil et al. | 242/413.9 |
| 2003/0226928 | A1 | 12/2003 | McNeil | |

FOREIGN PATENT DOCUMENTS

| | | |
|---|---|---|
| EP | 0 498 039 B1 | 12/1994 |
| GB | 2105688 A | 3/1983 |

* cited by examiner

*Primary Examiner*—Peter M Cuomo
*Assistant Examiner*—William E Dondero
(74) *Attorney, Agent, or Firm*—Peter D. Meyer

(57) ABSTRACT

A theoretical based winding process and control for a surface winding machine that can provide the capability to wind products with a desired wind profile, uniform sheet compression, improved compressibility, winding stability, and ease of operator control adjustment, is disclosed herein. The theoretical based surface winding process utilizes the principle of winding a log with a desired wind profile by controlling the surface speed of at least one roller of the surface winding machine.

20 Claims, 5 Drawing Sheets

Legend:

——— = Theoretical Lower Roller Speed Profile

— · — = Modified Theoretical Lower Roller Speed Profile

— — - = Adjusted Lower Roller Speed Profile

METHOD FOR A SURFACE REWIND SYSTEM

FIELD OF THE INVENTION

The present invention is directed to an improved method for operating and controlling a surface rewinding machine. This includes a method for the formation of logs or rolls of web material wound on a central core.

BACKGROUND OF THE INVENTION

As known to those skilled in the art, a surface rewinder is generally used for producing smaller diameter logs, or rolls, of web material wound upon a central core from large diameter parent rolls. Typically, these machines are used in the paper converting industry to produce rolls of bath tissue, kitchen towels, all purpose wipes, and the like. It is known that formed logs of web material may be as long as 510 centimeters and have an outer diameter of about 10 to 15 centimeters. The formed logs of web material are then subsequently cut transversely to their axis to obtain small rolls of wound web material that may have a length ranging from 10 to 30 centimeters in length.

Several types of surface rewinders are commercially available. One available type of surface rewinder is embodied as a three-drum cradle. Exemplary three-drum cradle surface rewinders are described in U.S. Pat. Nos. 4,327,877; 4,487,377; 4,723,724; 4,828,195; 5,979,818; 6,648,266; U.K. Patent No. 2,105,688; and EPO Patent EP-A-0 498 039. Another exemplary surface rewinder utilizes a speed change among a plurality of rollers to move logs of partially wound web material from one side of a pair of winding rollers to the other. Such an exemplary surface rewinder is described in U.S. Pat. No. 4,327,877. Yet still another type of surface winder utilizes a moveable winding drum. Exemplary moveable winding drums are detailed in U.S. Pat. No. 4,909,452.

Even though certain of these exemplary surface rewind machines are commercially available, those of skill in the art have realized that these machines have certain drawbacks. Primary among these drawbacks is the fact that product produced from these exemplary rewind systems are known to have non-uniform wind profiles. A typical non-uniformly wound product generally exhibits a non-uniform wind profile by having visually observable tight and loose portions in the wound roll. Such tight and loose portions in the wound roll can be shown by the use of conventional measurement techniques known by those of skill in the art.

Additionally, certain of these exemplary surface rewind systems are known to provide wound rolls having significant compression of the wound sheets near the core of the roll. This requires a looser wind for the rest of roll to achieve the desired product diameter when winding a product of fixed wound length, resulting in the finally wound product having a higher average compressibility than a corresponding uniformly wound web material. Additionally, certain of the exemplary surface rewind systems can cause logs to become unstable during the winding of low-density wound rolls. Such log instability can limit the speed of the rewinder as well as the rewinder throughput capability.

In an attempt to deal with these winding problems, currently available surface rewinding equipment requires the operator to provide adjustment of multiple, and complex, control settings that are interdependent and not related to the theory of the winding process. This complexity adds a high degree of uncertainty in the ability to provide a process that produces a uniformly wound product.

Many of the multiple control settings generally control the lower roller speed of a surface rewinder. These multiple control settings define the amount of deceleration and the duration of deceleration of the lower roller relative to the other rollers throughout the winding cycle. As the winding progresses throughout the winding cycle, the lower roller speed typically transitions linearly between these defined control settings. Thus, it should be clear that these current surface rewinder control methods are non-theoretically based and cause non-uniformly wound rolls. This approach can be particularly problematic when winding low-density products having large diameters with little total wound paper length.

Thus, there is a need to provide a true theoretical winding control process with simplified operator controls that is capable of producing a desired winding profile. Such a preferred theoretical process should be based upon the principle of winding a web material uniformly about a core. It is believed that such a theoretical process can provide the unique capability to deliver a more consistent and uniform wind and can increase the capability, throughput, and product compatibility of a surface rewinding process.

SUMMARY OF THE INVENTION

The present invention encompasses a method of controlling a roll winder for winding a product. The roll winder has at least a roller having an adjustable surface speed. The method comprises the steps of calculating a desired log diameter or radius build profile, calculating a log motion profile according to the log diameter or radius build profile, determining a roller surface speed profile according to the log motion profile, and adjusting the surface speed of the roller according to the roller surface speed profile.

The present invention also provides a method of processing a web material. The method comprises the steps of providing a roll winder comprising at least a roller having an adjustable surface speed; providing the roll winder with a core, the roll winder being capable of winding the web material about the core; calculating a desired log diameter or radius build profile; calculating a log motion profile according to the log diameter or radius build profile; determining a roller surface speed profile according to the log motion profile; adjusting the surface speed of the roller according to the roller surface speed profile; and, winding the web material about the core according to the roller surface speed profile.

DETAILED DESCRIPTION OF THE INVENTION

Figure 1:
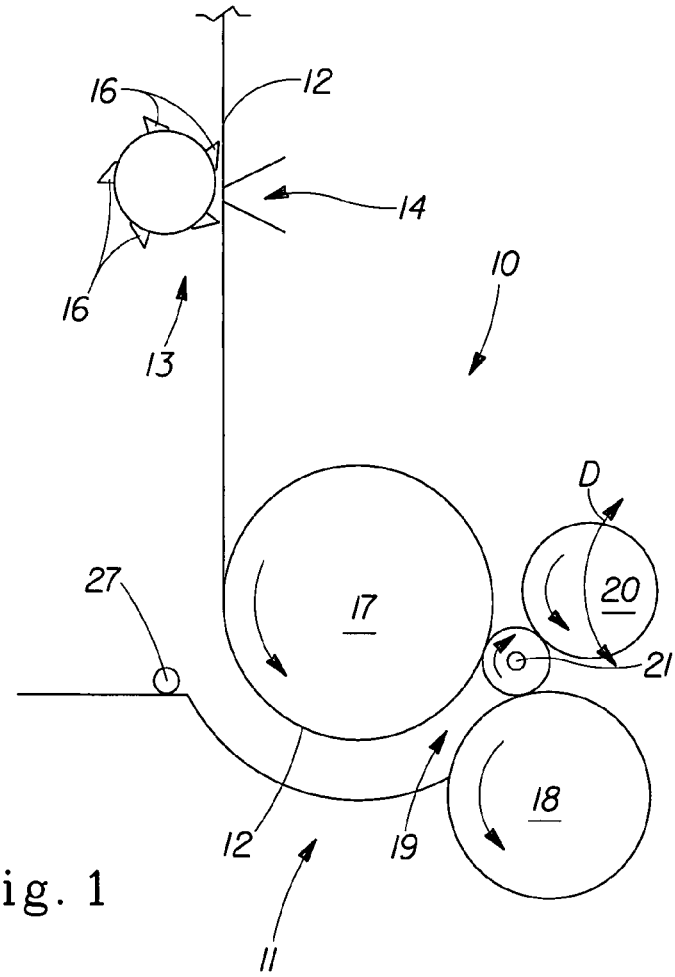
FIG. 1 is a schematic view of a winding apparatus suitable for use with the present invention.

FIG. 1 depicts the basic elements of a surface rewinding machine 10 (also referred to herein as surface rewinder 10 or rewinder 10). A web material 12 is fed from a supply parent roll (not shown) to the winding region 11 of the rewinder 10. Virtually any known process upstream of winding region 11 could process the web material 12. Such processes may include, but not be limited to, embossing, lotioning, coating, printing, combining of two or more web materials, combinations thereof, and the like. Generally, the web material 12 is fed through a perforation assembly 13. As is known to one of skill in the art, a perforation assembly 13 can be provided with a non-rotating support 14 and a rotating perforation roller 15 having blades 16 disposed thereon. As would also be known to one of skill in the art, the non-rotating support 14 can be provided with a blade (not shown) which is cooperatively associated with blades 16 disposed upon rotating perforation roller 15 to provide a line of perforations across web material 12.

Downstream of the perforation assembly 13 are disposed an upper roller 17 and a lower roller 18. Generally, upper roller 17 and lower roller 18 rotate in the same direction and are spaced to form a gap 19 through which the web material 12 and/or log 21 can pass. Optional rider roller 20 can be attached to an arm (not shown) in order to provide articulable movement along axis D. Movement of rider roller 20 along axis D provides a region where the rolling and ensuing winding of each log 21 is completed and can accommodate the resulting diameter increase of web material 12 wound upon each log 21. As would be known to one of skill in the art, a web material 12 could be wound into a finally wound product without the presence of a core 27. In other words, a finally wound product may have the form of a wound log 21 with, or without, a core disposed therein.

Figure 2:
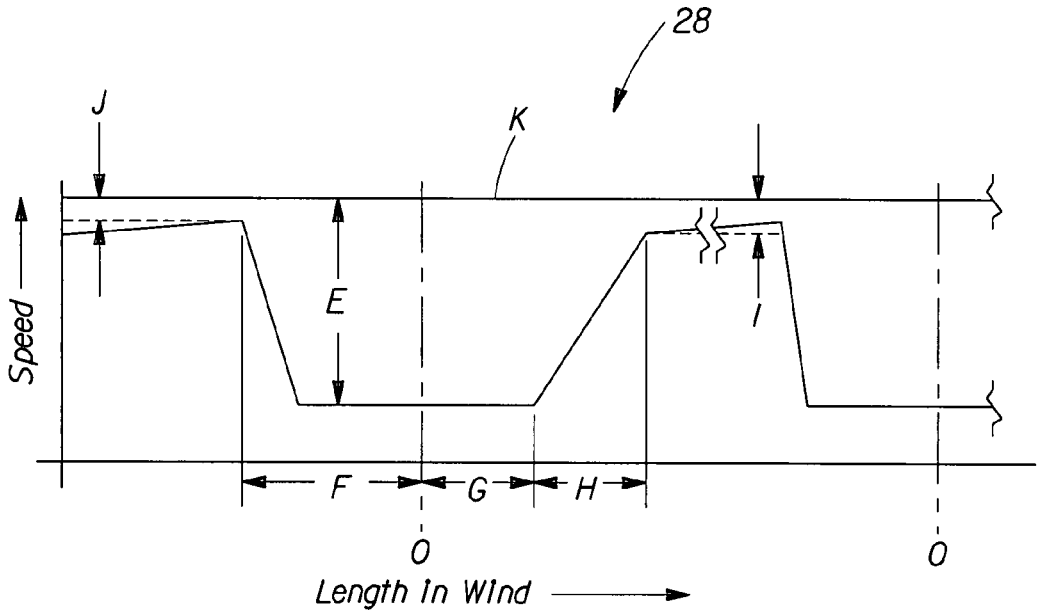
FIG. 2 is a graphical representation of a surface speed profile of a winding apparatus known in the prior art.

As shown in FIG. 2, lower roller 18 is generally provided with a surface speed profile relative to the surface speed K of the other winding rollers that can utilize multiple operator control set-points. By an operator setting the various and exemplary control set-points, a surface speed versus wound length profile similar to that shown in FIG. 2 is generated. These set-points can include deceleration percent E, deceleration start point F, deceleration period G, acceleration period H, beginning speed percent I, and ending speed percent J.

As shown in the graph of FIG. 2, deceleration percent E defines the amount of deceleration of the lower roller 18 relative to the other winding rollers at the point of transferring the web material 12 to a new winding log 21. Deceleration start point F defines the point in the winding process prior to transfer that the lower roller 18 begins to decelerate to the deceleration percent E speed. Deceleration period G, is the period in the winding process after transfer that lower roller 18 remains at the decelerated speed defined by deceleration percent E. Acceleration period H defines the period in the winding process during which lower roller 18 accelerates from the deceleration percent E speed to the beginning speed percent I after the transfer process. Ending speed percent J defines the final decelerated speed for the lower roller 18 near the end of the log 21 winding just prior to the transfer process. These settings can allow the operator to control the winding process through the various phases of the winding process. However, these settings are somewhat arbitrary and are not based upon any theoretical control of the winding process. Experience has determined that this method of control is not adequate to produce rolls of web material 12 having a desired uniform wind profile.

It was surprisingly found that controlling lower roller 18 according to the herein described theoretical process can consistently produce a uniformly wound product about a core (i.e., uniform wind or web layer thickness throughout the entire wind) as well as allow for minimized compression on the initial sheets of a wind. In other words, controlling the surface winder 10 according to the theoretical process described infra provides the capability to deliver a more uniform wind and can increase the surface winding capability of a surface rewinder 10 to wind low-density products. However, it should also be realized that this same theoretical process could also be used or adapted by one of skill in the art to control the speed and/or position of any roller within a surface rewinder system 10. It is also believed that the herein described theoretical process for providing a uniformly wound product about a core could be adapted by one of skill in the art to virtually any type of rewinding system to wind any type of web material 12.

A Theoretical Based Surface Winding Process

The theoretical surface winding process described herein is based upon winding a rolled product (i.e., log 21) about an optional central core with a uniform wind profile throughout the entire wind. However, this same method could be used to wind a log 21 with any desired wind profile. The first step in the described process is the calculation of the uniform diameter or radius build for a uniform wind profile.

1. Calculation of the Theoretical Uniform Diameter or Radius Build

The radius or diameter build of a wound product is a function of at least one characteristic of the log 21. Exemplary characteristics of the log 21 include, but should not be limited to, the wound length, total or finished product wound length, target finished product (i.e., log 21) diameter or radius, core radius or diameter, combinations thereof, and the like. One of skill in the art would also realize that the radius or diameter build can be more specifically, a function of a ratio representing the amount of web material 12 wound relative to the total amount of web material 12 to be wound, the target finished product (i.e., log 21) radius or diameter, and optionally the core radius or diameter. The ratio representing the amount of web material 12 wound relative to the total amount of web material 12 to be wound can be determined by the ratio of wound material 12 length to total product wound length as described infra, cycle degrees while winding to total winding cycle degrees in a wind (such as a 360 degree segmented cycle), raw feedback signal increments to total feedback signal increments within a wind, or any other method known in the art which divides the total wind into segments that can be tracked and then expressed as a ratio of the in-progress segment to the total segments representing the entire wind cycle. As would be known to one skilled in the art, any of these methods should be considered as equivalent to the ratio of wound length to total product wound length.

Without desiring to be bound by theory, it is believed that the calculation for radius build as a function of wound product length is the following:

$$r_w(l_w) = \sqrt{\frac{l_w}{l_{tw}} \cdot [(r_{finished\ \log})^2 - (r_{core})^2] + r_{core}^2}$$

where: $r_w(l_w)$=wound radius as a function of wound length;

$l_w$=wound length;

$l_{tw}$=total product wound length;

$r_{finished\ log}$=target finished product radius; and, $r_{core}$=core radius.

The above calculation is based upon the assumption that each layer forming log 21 is of uniform thickness. Although the radius build is desired for any of the calculations demonstrated herein, one of skill in the art could adapt the equations described herein upon the diameter build of the log 21 in order to achieve the desired winding profile.

The wound length (i.e., length of paper wound on the log 21 at any point in the wind), $l_w$, can be determined with a reasonable degree of accuracy from feedback used to relate the length of web material 12 wound into log 21. The wound length should be considered to include factors such as overall web material 12 strain and the like. It is in this way that the feedback can be considered as a master signal from which all winding axis control may be referenced. One of skill in the art may utilize encoder feedback to relate encoder counts from the perforation assembly 13. However, it should be realized by one of skill in the art that other feedback devices and methods, such as a resolver, Doppler laser velocimeter, tachometer, and the like, can be used to relate such a feedback signal to a measured point in the wind. Additionally, a useful master signal could be obtained by one of the process rollers or even a sensor that relates a physical property of a wound roll to the wound length.

In accordance with the present invention, the wound length may be related to the feedback counts as follows:

$$l_w = \frac{EFC}{\left(\frac{EC}{l_u}\right)}$$

where: EFC=Encoder Feedback Counts;

EC=Encoder Counts; and, $l_u$=unit length.

For example, an encoder connected to the rotating perforation roller 15 of perforation assembly 13 can provide a master signal. Since the number of encoder counts per encoder revolution is known and because the encoder can be coupled to the perforation assembly 13, the number of encoder counts per revolution of the perforation roller 15 can be known to be the same, or some known ratio thereof. If the number of blades 16 on the rotating perforation roller 15 is known, the number of individual sheets for each revolution of the rotating perforation roller 15 is also known. The relationship of encoder counts per sheet can then be found by the quotient of encoder counts per perforation roller 15 revolution and the number of sheets per perforation roller 15 revolution. Target sheet length can be determined by knowing the number and spacing of blades 16 disposed upon rotating perforation roller 15 and the surface speed of rotating perforation roller 15 relative to web material 12. Furthermore, since the target sheet length of the product is known, the quotient of encoder counts per sheet and sheet length results in the relationship or scaling of encoder counts to a unit length wound on a log 21. Thus, if the sheet count of the finally wound product is known, the total encoder counts comprising a wound product is known. This relationship can be expressed as follows:

$$\frac{EC}{\text{sheet}} = \frac{\left(\frac{EC}{rev_{rotating\ roller}}\right)}{\left(\frac{\#Blades_{rotating\ roller}}{rev_{rotating\ roller}}\right)}$$

where: $rev_{rotating\ roller}$=rotating perforation roller 15 revolutions; and, $\#Blades_{rotating\ roller}$=number of blades 16 disposed upon rotating perforation roller 15 and, $$\frac{EC}{l_u} = \frac{\left(\frac{EC}{\text{sheet}}\right)}{l_{sheet}}$$

where: $l_{sheet}$ = sheet length = $\frac{l_p}{sheet}$; and, $l_p$ = length of web material 12 in sheet and, $$\frac{EC}{\text{Wound Log}} = \frac{EC}{\text{Sheet}} \cdot \text{sheet count}$$

As the master signal feedback counts increment and reach a value equal to the total encoder counts per log 21, the master signal feedback count can be reset to zero. This then establishes a cycle representing the winding process of one log 21 with zero representing the start of the log 21 at transfer and the total value of encoder counts per log 21 representing the end of the winding log 21 at target product length.

One of skill in the art would realize that the master signal feedback counts can be phased or offset to align a zero count value to about the point of transfer in the log 21 transfer process which represents zero wound length. It should also be realized by one of skill in the art that the master signal feedback could also be used to determine the speed of the process rollers and the revolutions per minute of the process rollers. This can be based on the encoder counts per unit time, known roll specifications such as a given diameter, gear ratio, and the like, as well as product data for sheet length and number of sheets per perforation roller 15 revolution, as discussed supra.

The total or finished product wound length is calculated as the product of sheet length and sheet count. By way of example:

$$l_{tw}=l_{sheet}\cdot\text{sheet count}$$

where: $l_{tw}$=total product wound length.

Figure 3:
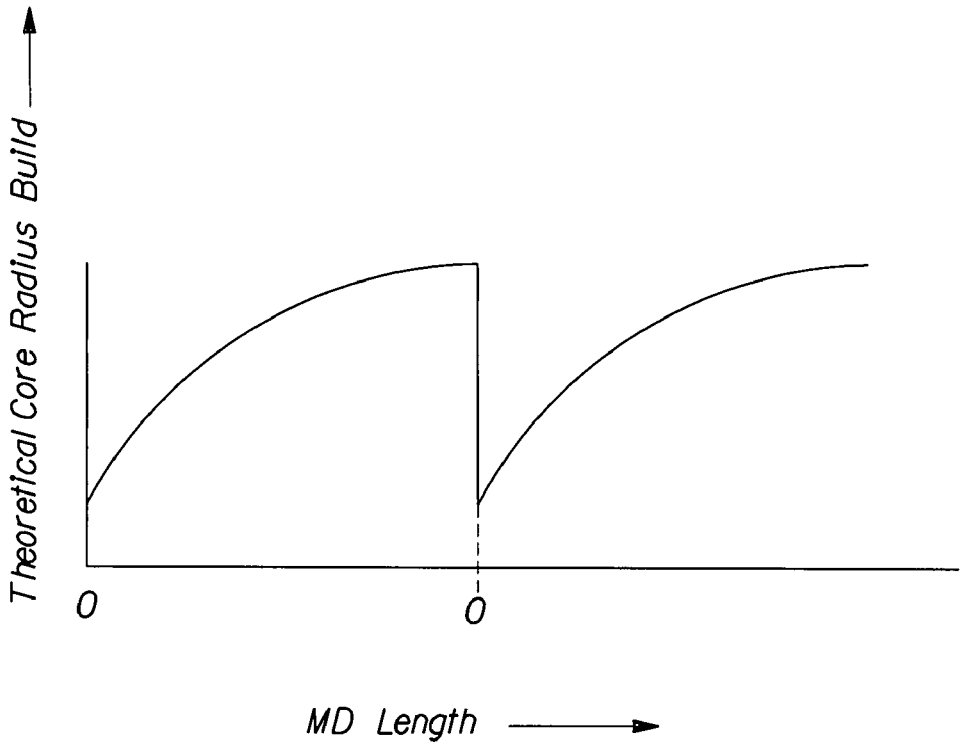
FIG. 3 is a graphical representation of an exemplary theoretical log radius build according to the present invention.

The target finished product log 21 radius, $r_{finished\ log}$, is calculated to be the target radius of the log 21 according to the product design for a given finished roll diameter. The target finished product log 21 radius can also be specified as a compressed radius of the finished wound product. One of skill in the art should realize that when using the compressed radius, the radius build is changed to provide a wind designed with some level of compression throughout the wind. One of skill in the art would also realize that alternative calculations could be used to determine a radius build based upon some other desired wound roll profile that is not uniform. However, any type of radius build profile can be generated based upon the desired properties of the final wound product. Exemplary alternative profiles can include tapers in which the thickness of each layer would increase or decrease from the center to the outside of the log 21, steps, local deviations from a uniform or other desired profile, combinations thereof, and the like. An exemplary theoretical uniform radius build is shown graphically in FIG. 3.

It should also be realized that the core radius, $r_{core}$, is the known radius of the cores used for the log 21 winding process. As intended by the present invention, the core radius, $r_{core}$, used in the above calculations should be zero for a coreless winding process.

2. Theoretical Log Motion (Translational Position, Translational Velocity, and Radial Growth Velocity) Based Upon the Theoretical Radius Build The theoretical log 21 motion to achieve a uniform radius build can be determined by a geometric relationship of the winding process rollers and the winding log 21 itself. The theoretical log 21 motion is also based upon the assumption of no slippage between the winding log 21 and process rollers, as well as tangent point contact between the winding log 21 and the process rollers. These assumptions could be discarded and the effects of slippage and/or non-tangent point contact could be accounted for in another manner in order to determine an alternate log 21 motion and an alternative winding process control method. However, it is believed that excluding these assumptions would provide for a radius build that is not uniform and/or theoretically based.

Figure 4:
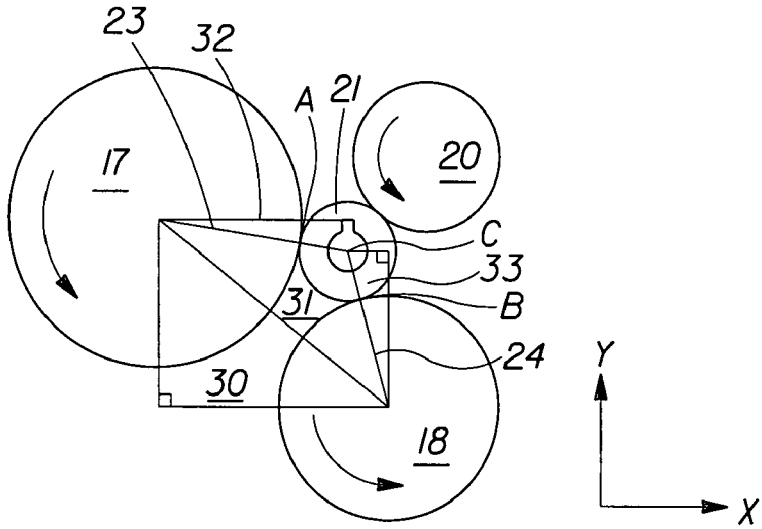
FIG. 4 is a schematic view of a winding apparatus showing the geometric relationships between the upper roller, lower roller, rider roller, and log.

As shown in FIG. 4, in order to determine theoretical log 21 motion in accordance with the instant invention, the geometric relationship between the process rollers should be known, specifically, the geometric relationship between upper roller 17 and lower roller 18. This includes the radius, or diameter, of the rollers and the coordinate location of the roller centers in XY plane coordinates. This then establishes the spatial relationship between the rollers comprising surface rewinder 10.

The origin and orientation of this X,Y plane coordinate system can be chosen arbitrarily. For example, the chosen coordinate location can be established by known coordinates or by known lengths and angles between roller centers with one of the roller centers defined as the origin. By knowing the geometric relationship between upper roller 17 and lower roller 18, as well as the uniform radius build, the coordinate location of the winding log 21 center C can be calculated at any point throughout the winding process. In other words, the coordinate location of the winding log 21 center C can be thought of as representing the theoretical position of the winding log 21 center C throughout the wind process according to the theoretical uniform radius build. For embodiments having moveable winding drums, or rollers, the motion profile of the winding drums, or rollers, should be known when calculating the coordinate location of the winding log 21 center C.

When the geometric relationship between upper roller 17 and lower roller 18 is known, a right triangle 30 with sides of known length, known internal angles, and having a hypotenuse between upper roller 17 and lower roller 18 centers is established. The adjacent sides of the right triangle are provided parallel to the direction of the axes of the chosen X,Y coordinate system (as shown).

Next, the length 23 between the center of upper roller 17 to the center C of log 21 and the length 24 between the center of lower roller 18 to the center C of log 21 are determined by the sum of the respective process roller's radius and the winding log 21 radius as determined from the theoretical uniform radius build. These lengths form a triangle 31 between the centers of the upper roller 17, the lower roller 18, and the log 21 having varying, but known, lengths.

Then, a third triangle 32 with sides of varying, but known, lengths is geometrically determined relative to the X-axis of the chosen coordinate system to the center of upper roller 17, and relative to the Y-axis of the chosen coordinate system to the center C of log 21, and the center of upper roller 17 to the center C of log 21. Likewise, another triangle 33 can be established with respect to lower roller 18 and log 21.

By knowing the geometric relationships between the upper roller 17, the lower roller 18, the log 21, and the theoretical uniform radius build, the lengths of the sides of each triangle are known. The internal angles of the triangles can then be calculated throughout the entire wind process. It should be realized that, the resulting internal angles and lengths data with similar geometric techniques could be used to calculate the coordinate location in the chosen X-Y plane of the log 21 center C through the entire wind process. In any regard, the chosen geometric technique should provide a coordinate location that represents the theoretical position of the log 21 center C throughout the entire wind process.

The derivative of the theoretical position of the log 21 center C throughout the wind process provides the theoretical translation velocity of the log 21 through the wind process. As would be realized by one of skill in the art, a derivative function can prove difficult to calculate as the position of log 21 center C is changing in real time and a master signal used to determine the wound length of web material 12 constituting log 21 would likely be represented by a discreet, non-continuous signal. However, the derivative can be approximated by calculating the change of both the X- and Y-coordinate positions of log 21 per controller scan. In this manner, the theoretical translation velocity of the log 21 can be calculated as the square root of the sum of the squared X and Y coordinate position change. Thus:

$$\Delta X_{(log)}=X_N-X_{N-1}$$

where: $\Delta X_{(log)}$=Change of log 21 center C X-coordinate position per controller scan;

$$X_N = X\text{-coordinate of log 21 center } C \text{ at scan } N;$$

$$X_{N-1} = X\text{-coordinate of log 21 center } C \text{ at scan } N-1;$$

and, $$\Delta Y_{(\log)} = Y_N - Y_{N-1}$$

where: $\Delta Y_{(log)}$=Change of log 21 center C Y-coordinate position per controller scan;

$Y_N$=Y-coordinate of log 21 center C at scan N;

$Y_{N-1}$=Y-coordinate of log 21 center C at scan N−1; and, $$V_t=\sqrt{(\Delta X_{(log)})^2+(\Delta Y_{(log)})^2}$$

where: $V_t$=Magnitude of Theoretical Translational Velocity of log 21 in length/scan.

The angle of the calculated theoretical translational velocity can be then determined from the X and Y components:

$$\Theta_2=\tan^{-1}(\Delta Y_{(log)}/\Delta X_{(log)})$$

where: $\Theta_2$=Angle of the translational velocity vector.

Likewise, a change of the uniform radius build per controller scan can be taken to approximate the theoretical radial growth velocity. This can be represented by the following equation:

$$V_r=(r_w)_N-(r_w)_{N-1}$$

where: $V_r$=Theoretical Radial Growth Velocity in length/scan;

$(r_w)_N$=radius of log 21 according to radius build profile at scan N; and, $(r_w)_{N-1}$=radius of log 21 according to radius build profile at scan N−1.

The theoretical radial growth velocity and theoretical log 21 translational velocity can then be used to determine the theoretical lower roller 18 surface speed profile.

The current embodiment uses approximations to calculate values that are actually derivatives for the winding process. These approximations provide velocity as a derivative of position. This approximation method may be suitable when utilizing a non-continuous, discreet, real time feedback signal used to determine wound length and the resulting uniform or other desired radius build and the corresponding theoretical log 21 translational position and radial growth. Alternatively, the derivative can utilize the actual mathematical functions for the known theoretical position and radial growth. In this instance, the derivative of these functions would establish an equation-based calculation for the respective velocities at the discreet feedback signal intervals. In yet another embodiment, the derivative calculations may be approximated or use a derivative function calculation in non-real time. The resulting values can then be stored and referenced by the surface rewinding system 10 as required. It should also be realized that approximations of the derivatives can be performed on a per controller scan basis. As would be known to one of skill in the art, alternative methods of evaluating the required derivatives are possible including, but not limited to, evaluating the derivatives on a per unit time basis, or evaluating the derivatives on a per unit wound length basis.

Figure 5:
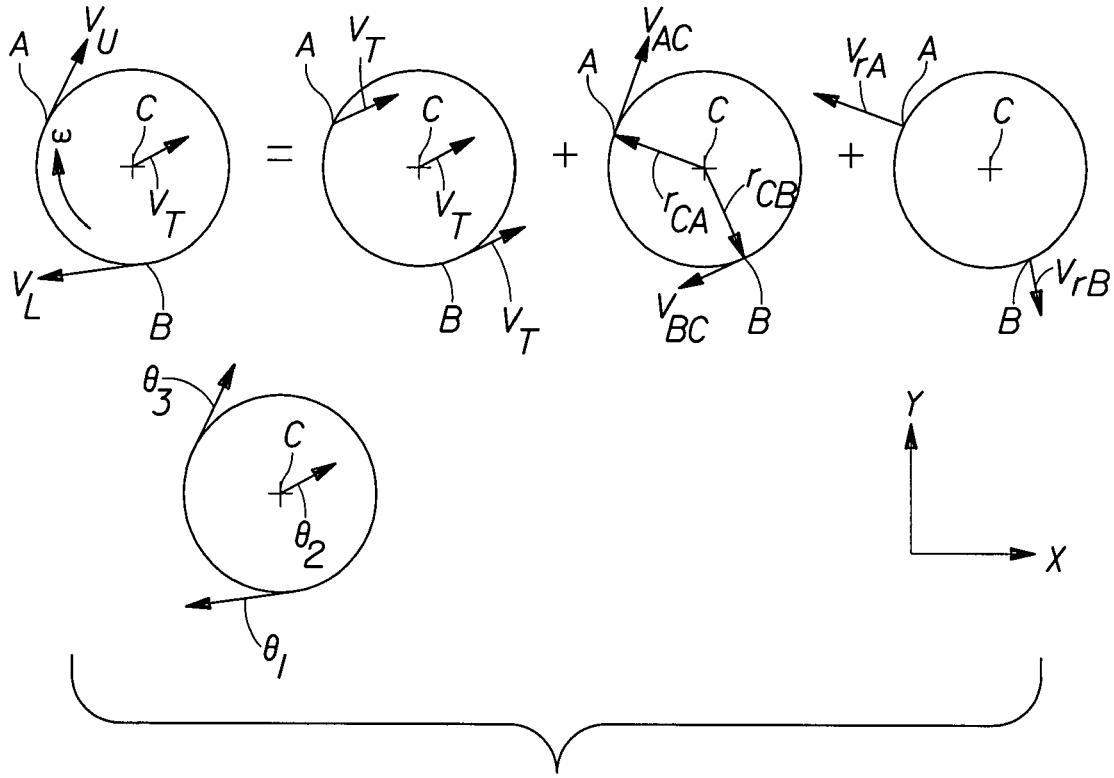
FIG. 5 is an exemplary graphic representation of the velocity vector components of a log being wound.

3. Theoretical Lower Roller Surface Speed Profile Based on Theoretical Log Motion for Theoretical Radius Build As shown in FIG. 5, the theoretical lower roller 18 surface speed profile is determined by decomposing the theoretical log 21 motion for a uniform radius build into vector components of translational, rotational, and radial growth velocity. These vector components can be analyzed at different physical points on the log 21 where these components may have different vector values. The theoretical log translation velocity, $V_t$, can be determined by the derivative of the theoretical log 21 center C position and can be known based on the calculations and assumptions as discussed supra. One of skill in the art should note that the log 21 translational velocity is the same vector in magnitude and angle at any physical point on the log 21. Likewise, the theoretical log 21 radial growth velocity, $V_r$, can also be known based upon calculations and assumptions discussed supra to provide a uniform log 21 radius build. It should be realized that the log 21 radial growth velocity can be the same magnitude at any physical point on the surface of log 21, but have a different vector because of the angular differences.

Referring again to FIG. 5 the surface speed of upper roller 17 is known and related to the rotational speed of the upper roller 17. This wind axis has a known angular velocity based upon a target web material 12 speed. If one were to assume that there is no slip between the winding log 21 and the winding rollers and tangent point contact for the log 21, the log 21 is at a matched surface velocity in both magnitude and direction to upper roller 17, $V_u$, at point A. Point A is the point on the log 21 surface in contact with upper roller 17. However, the surface velocity of lower roller 18, $V_l$, is unknown and the rotational velocity, ω, of the lower roller 18 is unknown. If one were to assume no slip and tangent point contact during the theoretical wind process, the log 21 has surface velocity matched to the lower roller 18 surface velocity, $V_l$, at point B.

The angles for all of the velocity vectors can be determined based upon the geometric relationship between the upper roller 17, lower roller 18 and winding log 21 described supra. Just as a coordinate location of the center C of the winding log 21 can be determined, a location for the contact point A between the upper roller 17, and the winding log 21 as well as the contact point B between the lower roller 18 and the winding log 21 can be determined via the respective geometric relationships. The angles of the velocity of the log 21 at these contact points must be tangent to the surface of the winding log 21 and in the direction of rotation of the log 21. Therefore, the angles $\Theta_1$ and $\Theta_3$ can be known. Furthermore, the angle for the radial growth velocity vector must be perpendicular to a line tangent to the surface of the winding log 21 and directed radially outward from log 21. Therefore, the angle of the radial growth velocity vector at the point of contact A between the upper roller 17 and winding log 21 is equal to the angle $\Theta_3$+90 degrees and the radial growth velocity vector at the point of contact B between the lower roller 18 and winding log 21 is equal to the angle $\Theta_1$+90 degrees.

The velocity vectors at the tangent contact points with both the upper roller 17 at point A and lower roller 18 at point B can be decomposed into rotational, translational, and radial growth components:

$$V_u=V_{ac}+V_t+V_{rA} \quad \text{equation (1)}$$

$$V_l=V_{bc}+V_t+V_{rB} \quad \text{equation (2)}$$

where: $V_u$=Velocity at the tangent contact point A between the log 21 and the upper roller 17

$V_{ac}$=Velocity of point A relative the center of the log 21;

$V_t$=Translational velocity;

$V_{rA}$=Radial growth velocity at point A;

$V_l$=Velocity at the tangent contact point B between the log 21 and the lower roller 18;

$V_{bc}$=Velocity of point B relative the center of the log 21; and, $V_{rB}$=Radial growth velocity at point B.

Also note that $V_{ac}$ and $V_{bc}$ are the rotational velocity components and can be determined by:

$$V_{ac}=\omega\times r_{ca} \text{ and}$$

$$V_{bc}=\omega\times r_{cb}$$

where: ω=the angular velocity of the log 21; and, $r_{ca}$=vector of the radius of the log 21 from point C to point A $r_{cb}$=vector of the radius of the log 21 from point C to point B.

Noting that each of the terms in equation 1 and equation 2 are vector quantities, both equations can then be further decomposed into components using i, j, and k unit vectors. This yields two equations with only two unknowns, ω and $V_l$. $V_u$, $V_t$, $V_{rA}$ and $V_{rB}$ are known components, as discussed supra. Therefore, all values and angles are known except for the angular velocity of the log 21, ω, in equation 1. This equation is then solved for ω and provides the instantaneous angular velocity of the log 21. This known angular velocity of the log 21, ω, can be used in equation 2. Thus $V_l$, the lower roller 18 surface velocity, can be determined. The following equations are exemplary of this method of determining the lower roller 18 surface velocity:

Velocity of upper roller 17 at contact point with log 21 at Point A (equation 1):

$$V_u \cdot \cos(\Theta_3) \cdot \vec{i} + V_u \cdot \sin(\Theta_3) \cdot \vec{j} = \omega \cdot \vec{k} \times \overrightarrow{r_{ca}} + V_t \cdot \cos(\Theta_2) \vec{i} + V_t \cdot \sin(\Theta_2) \vec{j} + V_{rA} \cdot \cos(\Theta_3 + 90) \cdot \vec{i} + V_{rA} \cdot \sin(\Theta_3 + 90) \cdot \vec{j}$$

$$V_u \cdot \cos(\Theta_3) \cdot \vec{i} + V_u \cdot \sin(\Theta_3) \cdot \vec{j} = \omega \cdot \vec{k} \times (r_{ca} \cdot \cos(\Theta_3 + 90) \vec{i} + r_{ca} \cdot \sin(\Theta_3 + 90) \vec{j}) + V_t \cdot \cos(\Theta_2) \vec{i} + V_t \cdot \sin(\Theta_2) \cdot \vec{j} + V_{rA} \cdot \cos(\Theta_3 + 90) \cdot \vec{i} + V_{rA} \cdot \sin(\Theta_3 + 90) \cdot \vec{j}$$

$$V_u \cdot \cos(\Theta_3) \cdot \vec{i} + V_u \cdot \sin(\Theta_3) \cdot \vec{j} = \omega \cdot r_{ca} \cdot \cos(\Theta_3 + 90) \vec{i} + \omega r_{ca} \cdot \sin(\Theta_3 + 90) \cdot -\vec{i} + V_t \cdot \cos(\Theta_2) \vec{i} + V_t \cdot \sin(\Theta_2) \cdot \vec{j} + V_{rA} \cdot \cos(\Theta_3 + 90) \cdot \vec{i} + V_{rA} \cdot \sin(\Theta_3 + 90) \cdot \vec{j}$$

$$V_u \cdot \cos(\Theta_3) \cdot \vec{i} + V_u \cdot \sin(\Theta_3) \cdot \vec{j} = [(-\omega \cdot r_{ca} \cdot \sin(\Theta_3 + 90)) + V_t \cdot \cos(\Theta_2) + V_{rA} \cdot \cos(\Theta_3 + 90)] \cdot \vec{i} + [(\omega \cdot r_{ca} \cdot \cos(\Theta_3 + 90)) + V_t \cdot \sin(\Theta_2) + V_{rA} \cdot \sin(\Theta_3 + 90)] \cdot \vec{j}$$

Velocity of lower roller 18 at contact point with log 21 at Point B (equation 2):

$$\overline{V_l \cdot \cos}(\Theta_l) \cdot \vec{i} + V_l \cdot \sin(\Theta_l) \cdot \vec{j} = \omega \cdot \vec{k} \times \overrightarrow{r_{ca}} + V_t \cdot \cos(\Theta_2) \vec{i} + V_t \cdot \sin(\Theta_2) \vec{j} + V_{rB} \cdot \cos(\Theta_l + 90) \cdot \vec{i} + V_{rB} \cdot \sin(\Theta_3 + 90) \cdot \vec{j}$$

$$V_l \cdot \cos(\Theta_l) \cdot \vec{i} + V_l \cdot \sin(\Theta_l) \cdot \vec{j} = \omega \cdot \vec{k} \times (r_{ca} \cdot \cos(\Theta_l + 90) \vec{i} + r_{ca} \cdot \sin(\Theta_l + 90) \vec{j}) + V_t \cdot \cos(\Theta_2) \vec{i} + V_t \cdot \sin(\Theta_2) \cdot \vec{j} + V_{rB} \cdot \cos(\Theta_l + 90) \cdot \vec{i} + V_{rB} \cdot \sin(\Theta_l + 90) \cdot \vec{j}$$

$$V_l \cdot \cos(\Theta_l) \cdot \vec{i} + V_l \cdot \sin(\Theta_l) \cdot \vec{j} = \omega \cdot r_{ca} \cdot \cos(\Theta_3 + 90) \vec{i} + \omega r_{ca} \cdot \sin(\Theta_3 + 90) \cdot -\vec{i} + V_t \cdot \cos(\Theta_2) \vec{i} + V_t \cdot \sin(\Theta_2) \cdot \vec{j} + V_{rA} \cdot \cos(\Theta_3 + 90) \cdot \vec{i} + V_{rA} \cdot \sin(\Theta_3 + 90) \cdot \vec{j}$$

$$V_u \cdot \cos(\Theta_3) \cdot \vec{i} + V_u \cdot \sin(\Theta_3) \cdot \vec{j} = [(-\omega \cdot r_{ca} \cdot \sin(\Theta_3 + 90)) + V_t \cdot \cos(\Theta_2) + V_{rA} \cdot \cos(\Theta_3 + 90)] \cdot \vec{i} + [(\omega \cdot r_{ca} \cdot \cos(\Theta_3 + 90)) + V_t \cdot \sin(\Theta_2) + V_{rA} \cdot \sin(\Theta_3 + 90)] \cdot \vec{j}$$

Solving for angular velocity, ω, using only the i vector components from equation 1:

$$V_u \cdot \cos(\Theta_3) = (-\omega \cdot r_{ca} \cdot \sin(\Theta_3 + 90)) + V_t \cdot \cos(\Theta_2) + V_{rA} \cdot \cos(\Theta_3 + 90 \cdot deg) -$$

$$\omega = \frac{V_u \cdot \cos(\Theta_3) + V_t \cdot \cos(\Theta_2) + V_{rA} \cdot \cos(\Theta_3 + 90 \cdot deg)}{r_{ca} \cdot \sin(\Theta_3 + 90)}$$

Solving for $V_l$ using the i vector components of equation 2:

$$V_l \cos(\Theta_l) = (-\omega \cdot r_{ca} \cdot \sin(\Theta_l + 90)) + V_t \cdot \cos(\Theta_2) + V_{rB} \cdot \cos(\Theta_l + 90 \cdot deg)$$

$$V_l = \frac{-\omega \cdot r_{ca} \sin(\Theta_l + 90) + V_t \cdot \cos(\Theta_2) + V_{rB} \cdot \cos(\Theta_l + 90 \cdot deg)}{\cos(\Theta_l)}$$

Figure 6:
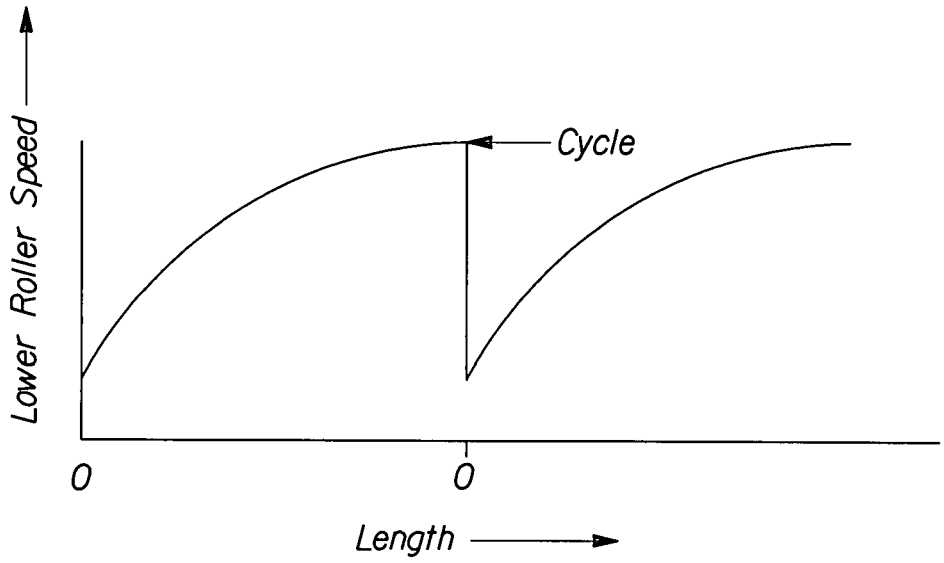
FIG. 6 is a graphical representation of an exemplary theoretical lower roller surface speed profile.

Determining the lower roller 18 surface velocity through the entire winding process provides the theoretical lower roller 18 surface speed profile. It should also be realized that other methods of solving a system of two equations with two unknowns could also be used to yield an appropriate result for the theoretical lower roller 18 surface velocity $V_l$. An exemplary theoretical lower roller 18 surface speed profile is shown in FIG. 6.

4. A Modified Theoretical Lower Roller Surface Speed Profile Based on Surface Winder Transfer Process and Operator Control Design Referring to FIGS. 7*a-d*, during the two-roller contact (log 21 to upper roller 17 and log 21 to lower roller 18) and three-roller contact (log 21 to upper roller 17, lower roller 18, and rider roller 20) phases of a typical surface winder process, the theoretical lower roller 18 surface speed profile can yield uniform theoretical winding. However, as would be appreciated by one of skill in the art, the theoretical lower roller 18 surface speed profile can optionally be modified to accommodate the transfer portions of the surface winder process. This could include transition of log 21 relative to upper roller 17 and stationary apparatus 26 and into the winding region 11. Therefore, it would be useful to modify the theoretical lower roller 18 surface speed profile prior to and/or immediately after log 21 transfer. The log 21 transfer process of the surface winder 10, as described herein, can be provided with any user selectable modifications to the lower roller 18 surface speed profile. As would be known to one of skill in the art and without desiring to be bound by theory, other variations of surface winders may have different or modified log 21 transfer processes. However, it is believed that the requirements of providing such modifications to the lower roller 18 surface speed profile are similar.

The chop off and transfer functionality can be achieved by any means known to one skilled in the art, including those referenced in U.S. Pat. Nos. 5,979,818; 5,772,149; and 6,056,229. Referring to the exemplary process depicted in FIG. 7*a*, transfer begins as the web material 12 total product length is finishing winding onto log 21. During transfer, the web material 12 can be separated at a targeted perforation by being pinched and/or nipped against upper roller 17 by cutoff apparatus 24. As should be known to those of skill in the art, cutoff apparatus 24 can operate at a different peripheral speed than upper roller 17. At the same time, a new log 25 is introduced to the winding region 11. The new log 25 can be provided with a cross-machine direction line of glue applied to the core and then pressed against the upper roller 17 causing the loose tail of web material 12 to stick to and begin to wrap the new log 25 as the web material 12 is separated at the identified perforation by cutoff apparatus 24. The new log 25 is then driven by the upper roller 17 and rolls along stationary apparatus 26 to the point at which the new log 25 reaches lower roller 18. During this traversal, the new log 25 is actively winding web material 12 to the new log 25 and translating at about 50% of the upper roller 17 surface speed.

Figure 7A:
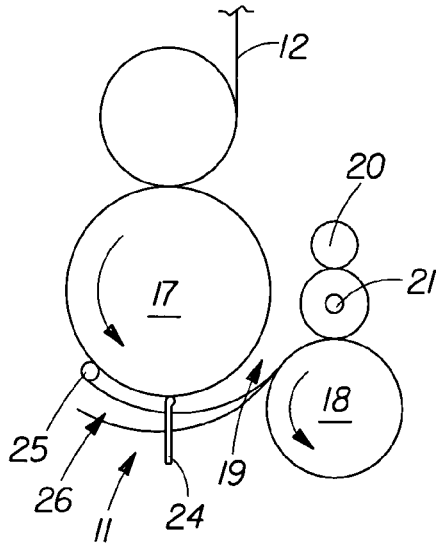
FIGS. 7*a*-7*d* are schematic views of a winding apparatus depicting the relationships between the upper roller, lower roller, rider roller, and log; and, FIG. 8 is a graphical representation of an exemplary modified theoretical lower roller surface speed profile and an exemplary adjusted lower roller surface speed profile overlaying a theoretical lower roller surface speed profile.
Figure 7B:
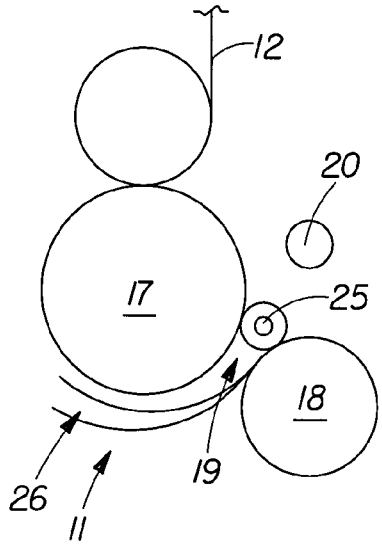
Figure 8:
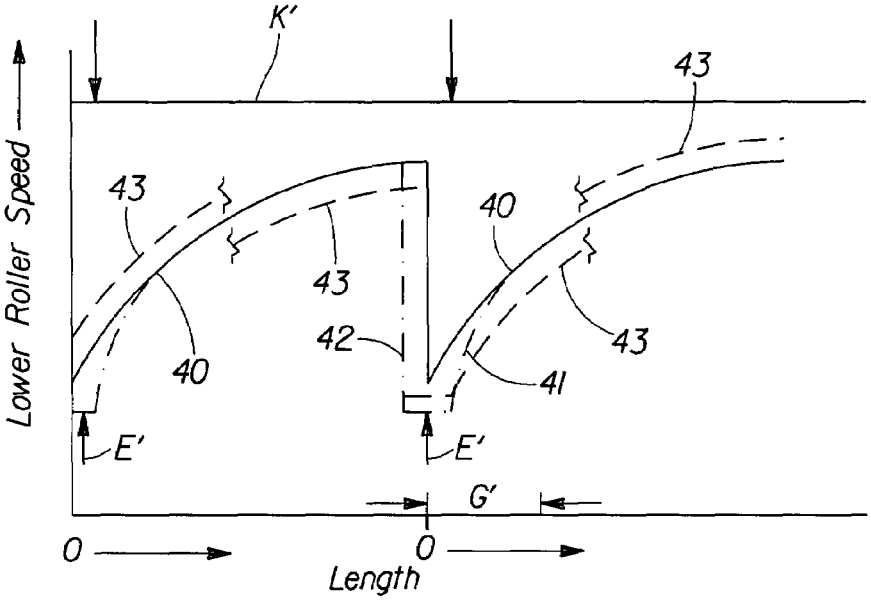

Referring to FIG. 7*b*, as the new log 25 contacts lower roller 18, the new log 25 enters gap 19 between the upper roller 17 and lower roller 18 and begins two-roller contact. The motion of the new log 25, as it traverses through gap 19, is preferably controlled by the speed of lower roller 18 relative to the upper roller 17. Specifically, a decelerated lower roller 18 surface speed is typically required in order for the new log 25 to progress outward through the gap 19 and minimize compression on the new log 25 resulting from a significant dwell time in the gap 19 while winding. Also, providing the lower roller 18 with a decelerated surface speed may be required to gain control of the new log 25 and rapidly decelerate the new log 25 from the high translation speed by being driven at about 50% of the upper roller 17 surface speed while moving through the stationary apparatus 26. The lower roller 18 surface speed can be modified from the theoretical surface speed profile as described supra for these reasons in order to control the new log 25 at a decelerated speed. This is generally referred to as the lower roller 18 deceleration at transfer E' (as shown in FIG. 8). The lower roller 18 deceleration at transfer E' can be used to control how quickly the new log 25 progresses through the surface winder 10 gap 19. The magnitude of the lower roller 18 deceleration at transfer E' speed and/or the duration G' (shown in FIG. 8) that the lower roller 18 is at the lower roller 18 deceleration at transfer E' speed can also be used to control how far the new log 25 moves through and out of the gap 19 between upper roller 17 and lower roller 18.

Figure 7C:
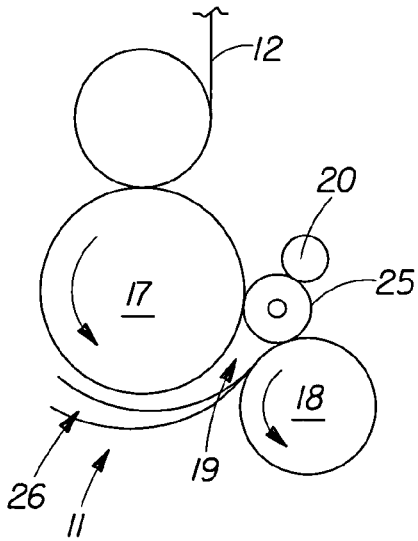

Referring to FIG. 7*c*, it is preferred that the desired theoretical process provide that new log 25 contact the rider roller 20 with controlled contact as the rider roller 20 reaches its minimum height point and establishes control of the new log 25 to initiate three-roller contact. Without desiring to be bound by any particular theory, the duration G' that the lower roller 18 is at the lower roller 18 deceleration at transfer E' speed can impact how far the new log 25 moves through and out of the gap 19 which can also directly impact how the new log 25 will be delivered to contact with the rider roller 20. Therefore, the duration G' of the lower roller 18 deceleration at transfer E' speed can be used to control and optimize the new log 25 contact with rider roller 20. This should be known to one of skill in the art as a method to control movement of the log 25 from 2-roller to 3-roller contact.

As the new log 25 contacts rider roller 20 and establishes the desired contact, the rider roller 20 can optionally be at a height based on the theoretical winding log 25 radius. In this optional, but preferred embodiment, the lower roller 18 speed is returned from the lower roller 18 deceleration at transfer E' surface speed to match the theoretical lower roller 18 surface speed profile at, or about, the point 40 (shown in FIG. 8) of rider roller 20 contact. This could establish that rider roller 20 growth or position and lower roller 18 surface speed are functioning in coordination and according to the theoretical radius build discussed supra. Note that the rider roller 20 contact point with the new log 25 can be provided as an operator-based control which along with the lower roller 18 duration G' of the deceleration at transfer E' surface speed can be used to control the new log 25 after transfer to the point of theoretical winding control. In other words, at about the point where new log 25 contacts rider roller 20, the lower roller 18 should be at about the surface speed determined by the theoretical radius build. In order for lower roller 18 to return to it's theoretical surface speed profile, it is believed that a transition 41 (shown in FIG. 8) from the deceleration at transfer E' speed to the theoretical surface speed profile will be required. One of skill in the art would be able to perform such a transition with any type of mathematical function known to provide such transitional behavior. Such mathematical functions can include, but not be limited to, linear functions, exponential functions, power functions, filtering functions, logarithmic functions, trigonometric functions, s-curve functions, combinations thereof, and the like. However, it should be realized that a preferable mathematical function suitable for use with the present invention would be a function that resembles an exponential decay between levels of deceleration. This exponential decay-like behavior between the levels of deceleration provides for a fast and smoothed transition that is preferred for decelerating the new log 25 translational velocity and providing control between the different levels of deceleration. This can also provide a reference velocity for lower roller 18 of surface rewinder 10 that can be more readily followed by the mechanical and/or electrical drive transmission systems of surface rewinder 10. One should realize that this transition method could provide improved capability to control the new log 25 deceleration compared to a transition method requiring instantaneous changes in lower roller 18 acceleration. Such instantaneous transitions necessitate instantaneous changes in the new log 25 deceleration that may not be possible in exemplary systems of the prior art. Thus, without desiring to be bound by theory, the herein described transition method can provide a surface rewind system 10 with the capability to more accurately control the new log 25. This can result in a finally wound product having minimal compression on sheets near the core of log 21 due to the ability of the lower roller 18 of surface rewind system 10 to reach a greater deceleration at transfer E' than any known prior art rewind systems, while maintaining control of the new log 25 throughout the transition.

Figure 7D:
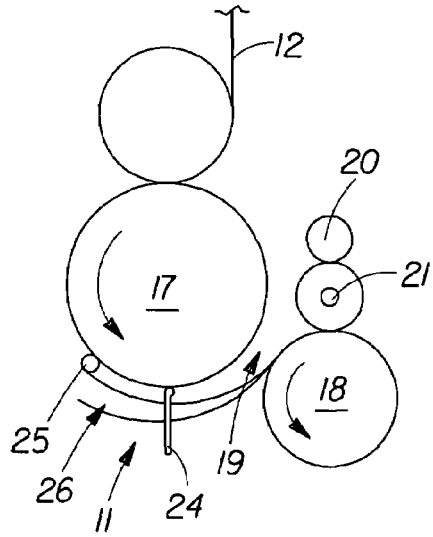

Referring to FIG. 7*d*, after three-roller contact is established, the new log 25 continues to wind based on the theoretical uniform winding process provided by the theoretical lower roller 18 surface speed profile discussed supra. The theoretical winding continues until just prior to the next transfer point. In order to eject the finished log 25 during the transfer process, the finished log 25 preferably moves outwardly and away from upper roller 17. This can be accomplished by either speeding up the rider roller 20, slowing down the lower roller 18, or a combination of both. This speed differential can result in the new log 25 moving outward as it finishes winding. As the new log 25 moves outward, new core 27 is inserted and begins to move along the path between upper roller 17 and stationary apparatus 26 toward lower roller 18. The lower roller 18 surface speed can, therefore, optionally be modified from the theoretical surface speed profile to accomplish this result. This optional modification would require that the speed of lower roller 18 be decelerated 42 (shown in FIG. 8) to the deceleration at transfer speed E' as would be known to one of skill in the art. This speed should preferably be established through the cutoff portion of the transfer process. This is the same speed as discussed supra for control of how quickly the new log 25 moves through the upper roller 17 and lower roller 18 gap 19.

In addition to modifying the theoretical lower roller 18 surface speed to achieve ejection of the finished new log 25 at transfer and translation of the newly inserted core 27 through the gap 19 between the upper roller 17 and lower roller 18, it may also be desirable to modify the lower roller 18 surface speed from the theoretical surface speed for the entire winding process. It may be desired to wind a log 21 tighter than, or looser than, what is provided by the herein described desired theoretical build. In an exemplary embodiment, this may be achieved by adding and/or subtracting a constant offset to the theoretically determined surface speed profile in order to create an adjusted lower roller 18 surface speed profile 43 (shown in FIG. 8). The modifications to the lower roller 18 surface speed profile are then relative to the adjusted lower roller 18 surface speed profile 43. One of skill in the art would realize that other methods of adjusting the lower roller surface speed 43 profile are possible, including, but not limited to, adding and/or subtracting a constant percentage difference from the theoretical lower roller 18 surface speed profile, adding and/or subtracting a tapered offset to the theoretical lower roller 18 surface speed profile, localized deviations, combinations thereof, and the like. In any regard, it should be readily apparent to one of skill in the art that the present inventive process provides increased product compatibility and simplified operator controls while at the same time providing the desired winding profile of a wound product.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of controlling a roll winder for winding a product, said roll winder having at least a roller having an adjustable surface speed, the method comprising the steps of:

a. calculating a desired log diameter or radius build profile;
b. calculating a log motion profile according to said log diameter or radius build profile;
c. determining a roller surface speed profile according to said log motion profile; and,
d. adjusting said surface speed of said roller according to said roller surface speed profile.

2. The method according to claim 1 wherein said step of calculating a desired log diameter or radius build profile further comprises the step of determining a characteristic of said product.

3. The method according to claim 2 wherein said step of determining a characteristic of said product further comprises the step of coupling a feedback device to said product prior to said product contacting said roller.

4. The method according to claim 2 wherein said characteristic of said product is selected from the group consisting of wound length, total or finished product wound length, target finished product diameter or radius, core radius or diameter, and combinations thereof.

5. The method according to claim 1 wherein said step of calculating a log motion profile further comprises the step of providing a log traversing proximate said roller with a theoretical position.

6. The method according to claim 5 further comprising the step of determining a translational velocity of said log by approximating a derivative of said theoretical position.

7. The method according to claim 1 wherein said step of determining said roller surface speed profile further comprises the step of decomposing said log motion profile into vector components of translational, rotational, and radial growth velocity.

8. The method according to claim 7 further comprising the step of utilizing said vector components to determine said roller surface speed profile.

9. The method according to claim 1 further comprising the step of modifying said roller surface speed profile to provide a modified surface speed profile.

10. The method according to claim 9 wherein said modified roller surface speed profile further comprises the step of determining a desired deceleration at transfer.

11. The method according to claim 10 further comprising the step of determining a deceleration period.

12. The method according to claim 10 wherein said modified roller surface speed profile is modified according to said desired deceleration at transfer.

13. The method according to claim 9 wherein said step of modifying said roller surface speed profile further comprises the step of changing the surface speed of said roller throughout said modified roller surface speed profile.

14. The method according to claim 9 further comprising the step of determining a rider roller minimum height contact point.

15. The method according to claim 14 further comprising the step of determining a roller speed transition function.

16. The method according to claim 15 wherein said speed transition function further comprises a function selected from the group consisting of linear functions, exponential functions, power functions, filtering functions, logarithmic functions, trigonometric functions, s-curve functions, and combinations thereof.

17. A method of processing a web material, the method comprising the steps of:

a. providing a roll winder, said roll winder comprising at least a roller having an adjustable surface speed;
b. providing said roll winder with a core, said roll winder being capable of winding said web material about said core;
c. calculating a desired log diameter or radius build profile;
d. calculating a log motion profile according to said log diameter or radius build profile;
e. determining a roller surface speed profile according to said log motion profile;
f. adjusting said surface speed of said roller according to said roller surface speed profile; and,
g. winding said web material about said core according to said roller surface speed profile.

18. The method according to claim 17 wherein said step of calculating said log diameter or radius build profile comprises the step of determining the wound length of web material.

19. The method according to claim 17 wherein said step of calculating a log motion profile further comprises the step of providing a log traversing proximate said roller with a theoretical position.

20. The method according to claim 17 further comprising the step of modifying said roller speed profile to provide a modified roller speed profile.

* * * * *